US007918424B1

(12) United States Patent
Wu et al.

(10) Patent No.: US 7,918,424 B1
(45) Date of Patent: Apr. 5, 2011

(54) SUSPENDING BUCKLE MECHANISM OF OUTPUT WATER DEVICE

(75) Inventors: Gangqiang Wu, Xiamen (CN); Qingshuang Li, Xiamen (CN); Bin Chen, Xiamen (CN); Huasong Zhou, Xiamen (CN)

(73) Assignees: Xiamen Solex High-Tech Industries Co., Ltd., Xiamen (CN); Huasong Zhou, Xiamen (CN)

( * ) Notice: Subject to any disclaimer, the term of this patent is extended or adjusted under 35 U.S.C. 154(b) by 0 days.

(21) Appl. No.: 12/717,338

(22) Filed: Mar. 4, 2010

(51) Int. Cl.

| | |
|---|---|
| ***A47B 96/00*** | (2006.01) |
| ***A47B 96/06*** | (2006.01) |
| ***A47K 1/00*** | (2006.01) |
| ***A47K 5/00*** | (2006.01) |
| ***A47K 3/20*** | (2006.01) |
| ***A47K 4/00*** | (2006.01) |
| ***E04G 5/06*** | (2006.01) |
| ***F16L 3/08*** | (2006.01) |
| ***F21V 21/00*** | (2006.01) |

(52) U.S. Cl. ..... 248/222.11; 248/222.12; 248/230.1; 248/218.4; 248/219.2; 4/567; 4/615; 4/903; 239/587.1; 285/921

(58) Field of Classification Search ..... 248/222.11, 248/222.12, 230.1, 297.51, 316.1, 316.7, 248/229.1, 309.3, 587.6, 587.1, 218.4, 219.2, 248/219.4; 4/567–568, 570, 604–606, 615, 4/596, 599, 601, 903; 239/587.6, 587.1; 285/133.11, 133.3, 319, 921

See application file for complete search history.

(56) References Cited

U.S. PATENT DOCUMENTS

| | | | | |
|---|---|---|---|---|
| 5,481,765 | A * | 1/1996 | Wang | 4/605 |
| 5,632,049 | A * | 5/1997 | Chen | 4/570 |
| 5,742,961 | A * | 4/1998 | Casperson et al. | 4/615 |
| 5,749,552 | A * | 5/1998 | Fan | 248/205.8 |
| 5,833,192 | A * | 11/1998 | Buhrman | 248/295.11 |
| 7,043,776 | B1 * | 5/2006 | Wu | 4/601 |
| 7,197,776 | B2 * | 4/2007 | Tsai | 4/615 |
| 7,293,302 | B2 * | 11/2007 | Mesa | 4/601 |
| 7,407,140 | B2 * | 8/2008 | Sen | 248/121 |
| 7,458,112 | B1 * | 12/2008 | Yang | 4/601 |
| 7,766,291 | B2 * | 8/2010 | Eilmus et al. | 248/222.11 |
| 2006/0230520 | A1 * | 10/2006 | Tsai | 4/567 |
| 2007/0245483 | A1 * | 10/2007 | Eilmus et al. | 4/567 |
| 2008/0224009 | A1 * | 9/2008 | Song | 248/309.3 |
| 2009/0032663 | A1 * | 2/2009 | Fan | 248/309.3 |
| 2009/0265848 | A1 * | 10/2009 | Tsai | 4/615 |

* cited by examiner

*Primary Examiner* — Terrell Mckinnon
*Assistant Examiner* — Christopher Garft
(74) *Attorney, Agent, or Firm* — Rabin & Berdo, P.C.

(57) ABSTRACT

A suspending buckle mechanism of output water device, which connects to a supporting arm protruding out of a wall, includes a sucker mechanism, a suspending tube, a supporting hoop and an elastic buckle. The suspending tube has an upper part with a through fixing hole and a lower part fixed to the sucker mechanism. The supporting hoop includes: a connecting sleeve, on which an axial groove is internally and externally disposed, and two connecting sheets. Through holes are disposed in the connecting sheets. The connecting sheets are symmetrically fixed around the connecting sleeve. The elastic buckle is placed between the connecting sheets. The connecting sheets are inserted in the upper opening of the hanging tube in order to make the convex columns of the elastic buckle protrude out of the through hole and then inserted in the fixing hole, so that the connecting sleeve can clasp the supporting arm.

6 Claims, 4 Drawing Sheets

SUSPENDING BUCKLE MECHANISM OF OUTPUT WATER DEVICE

FIELD OF THE INVENTION

The present invention relates to a part of an output water device, and especially relates to a suspending buckle mechanism of an output water device.

BACKGROUND OF THE INVENTION

The conventional suspending mechanism of the output water device, which connects to a supporting arm protruding out of the wall, includes a suspending tube. The top of it forms a fixing sleeve to fixed cover the support arm. The conventional suspending mechanism has the following shortages: 1. the suspending tube is suspension connected, so it is easy-to-shake; 2. the fixing sleeve is fixed to the supporting arm. If the connection of the fixing sleeve and the supporting arm is a tight fit, the assembly is not convenient and the supporting arm may be damaged. If the connection of the fixing sleeve and the supporting arm is a loose fit, the structure is easy to shake and it is inconvenient to use.

SUMMARY OF THE INVENTION

The present invention provides a part of the output water device which overcome the shortages of the conventional technique.

The present invention applies the following technical solution:

A suspending buckle mechanism of output water device, which connects to a supporting arm protruding out of the wall, comprises:

A sucker mechanism, which can be absorbed on the wall;

A suspending tube, which includes an upper part and a lower part, wherein the lower part fixed to the sucker mechanism and the upper part has a through fixing hole in it;

A supporting hoop, comprising a connecting sleeve and two connecting sheets, wherein an axial groove which is through internal and external is disposed in the connecting sleeve, and the two connecting sheets, in which a through hole is disposed, are fixed to the connecting sleeve and placed symmetrically around it;

An elastic buckle, which is disposed between the two connecting sheets, has convex columns;

The connecting sleeve covers the supporting arm and the two connecting sheets insert in the upper opening of the hanging tube in order to make the convex columns of the elastic buckle to protrude out of the through hole and to insert in the fixing hole, so that the connecting sleeve can clasp the supporting arm.

In a preferred embodiment, the two connecting sheets are arc-shaped sheets whose axis coincides, and their diameters are same. Besides, the outside diameter of the arc-shaped sheet is no less than the inside diameter of the top opening of the suspending tube.

In a preferred embodiment, the elastic buckle comprises a cross bar and two elastic suspending arms which are placed symmetrically around the cross bar, and two convex columns are respectively disposed on the sides of the two suspending arms.

In a preferred embodiment, the present invention also includes a slide component which is sliding connected to the suspending tube.

In a preferred embodiment, a three-way valve is disposed at the end of the supporting arm, and the three-way valve is connected to a water pipe whose end is also connected to the slide component.

In a preferred embodiment, the sucker mechanism comprises:

A sucker, comprising a sucker base and a lever fixed in the center of the sucker base;

A wall base fixed to the sucker, which has a wall cover and a connecting part fixed to the wall cover;

A cover, which could be detachably fixed to the wall base, and forms a slot together with the connecting part;

A button and an elastic component, the end of the lever inserts the slot and fixes the button, and the elastic component is disposed between the button and the wall base.

Compared to the conventional technique: 1. Because the supporting hoop has a groove and has elasticity, when the connecting sheets are inserted in the top opening of the suspending tube, elastic force could be produced to make the supporting hoop to clasp the supporting arm, so that the assembly is convenient and the connection of the supporting arm is tight fit in order to avoid the problem of sliding and shaking; 2. Because the sucker mechanism and the assembly of the supporting hoop and the elastic buckle are respectively connected to the lower part and the upper part of the suspending tube, the tube is stable and the problem of shaking is avoided; 3. Because the button and elastic component are disposed in the sucker mechanism, when the button is pressed, the absorption of the sucker is loosened; when the button is released, under elastic force and pressure, the adsorption force is recovered; 4. Owing to the tight fit of the two connecting sheets and the top of the suspending tube, the hold force of the connecting sleeve can be greater.

DESCRIPTION OF THE PREFERRED EMBODIMENTS

Figure 1:
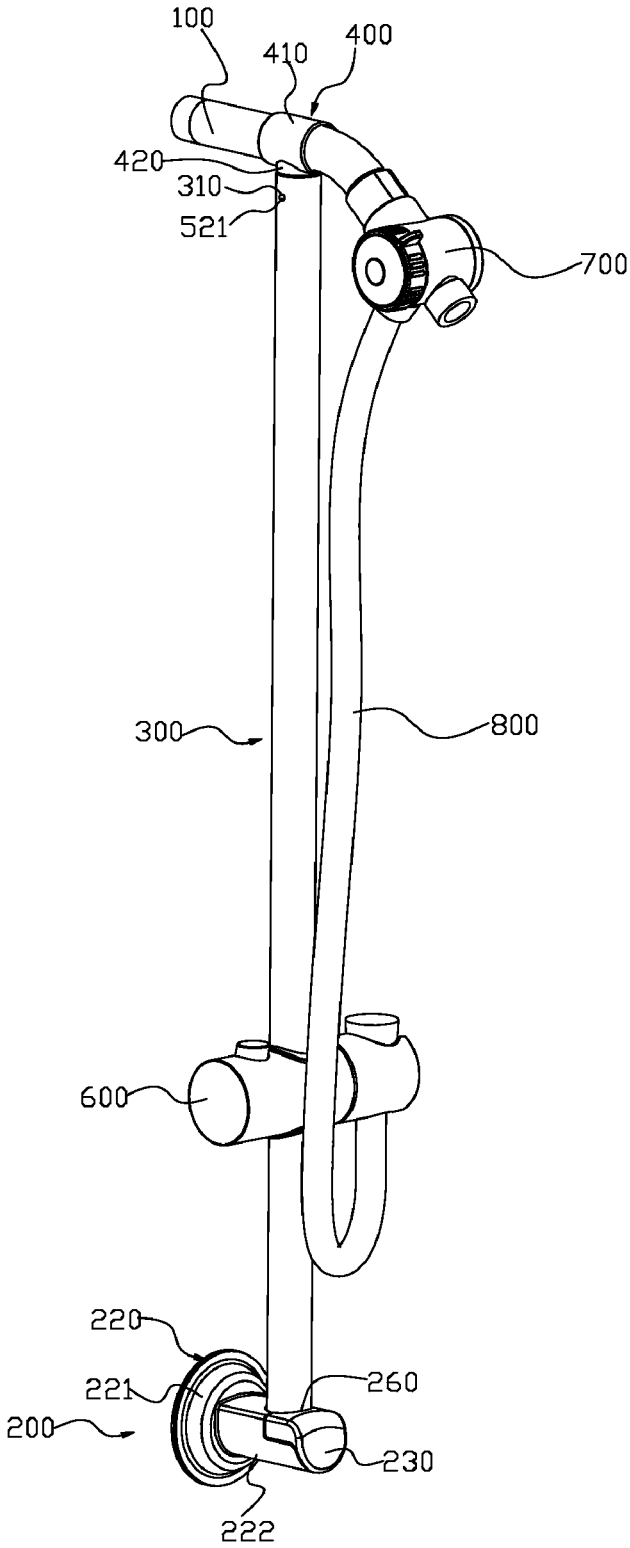
FIG. 1 is a three-dimensional diagram of said suspending mechanism in a preferred embodiment of the present invention.

Referring to FIG. 1 through FIG. 5, a suspending buckle mechanism of the water output device, which is connected to a supporting arm 100, comprises a sucker mechanism 200, a suspending tube 300, a supporting hoop 400, an elastic buckle 500 and a slide component 600.

Figure 2:
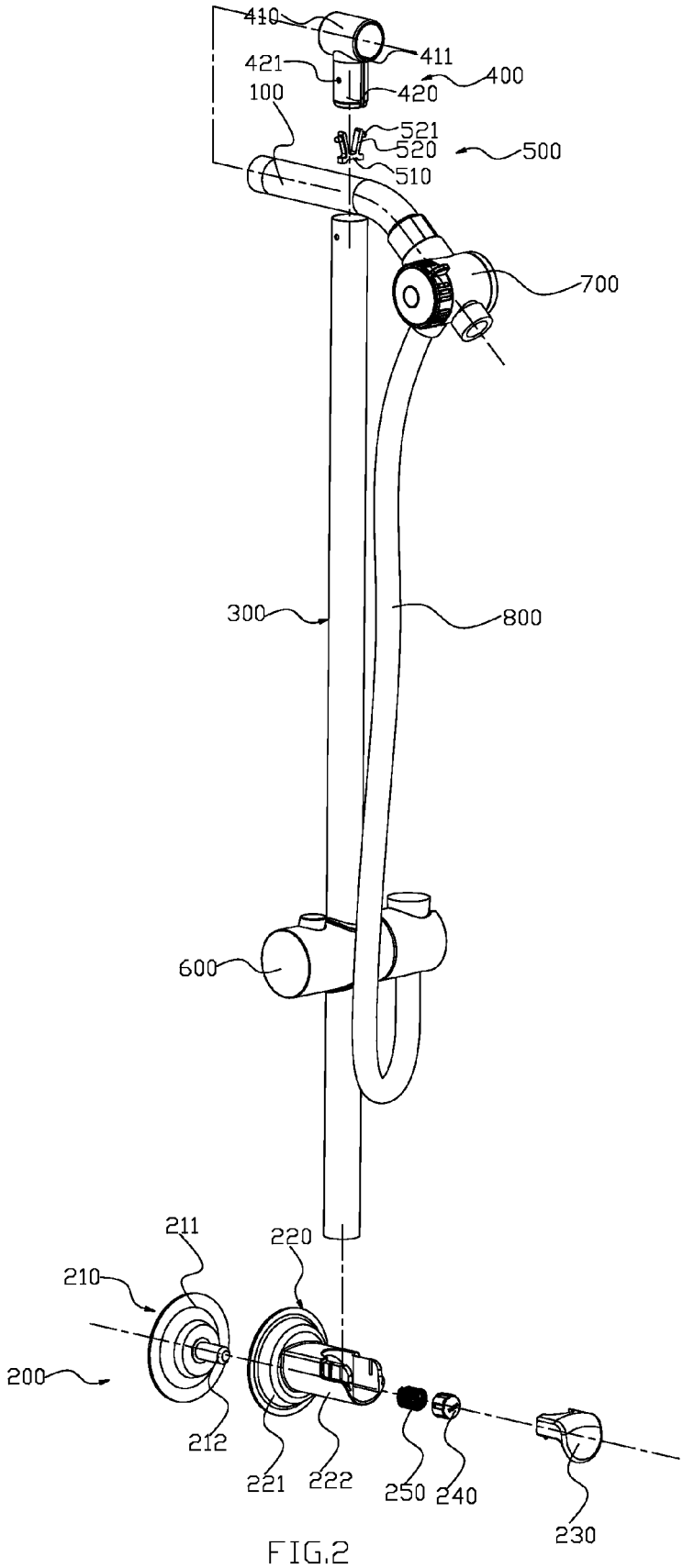
FIG. 2 is a three-dimensional exploded diagram of said suspending mechanism in a preferred embodiment of the present invention.
Figure 3:
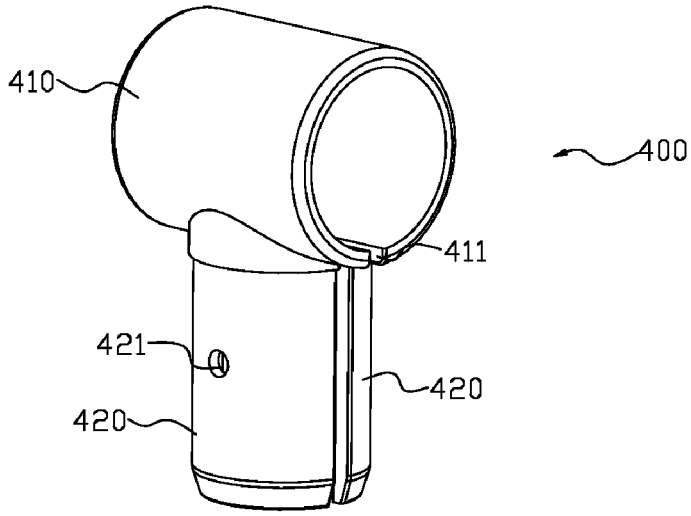
FIG. 3 is a three-dimensional diagram of the supporting hoop of said suspending mechanism in a preferred embodiment of the present invention.
Figure 4:
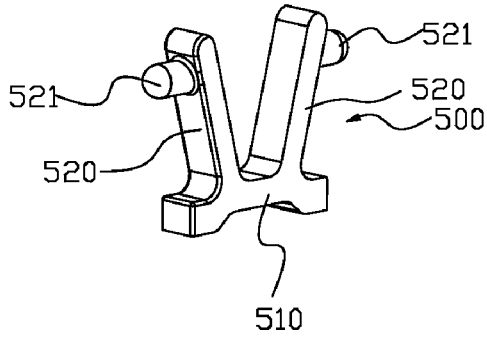
FIG. 4 is a three-dimensional diagram of the elastic buckle of said suspending mechanism in a preferred embodiment of the present invention.
Figure 5:
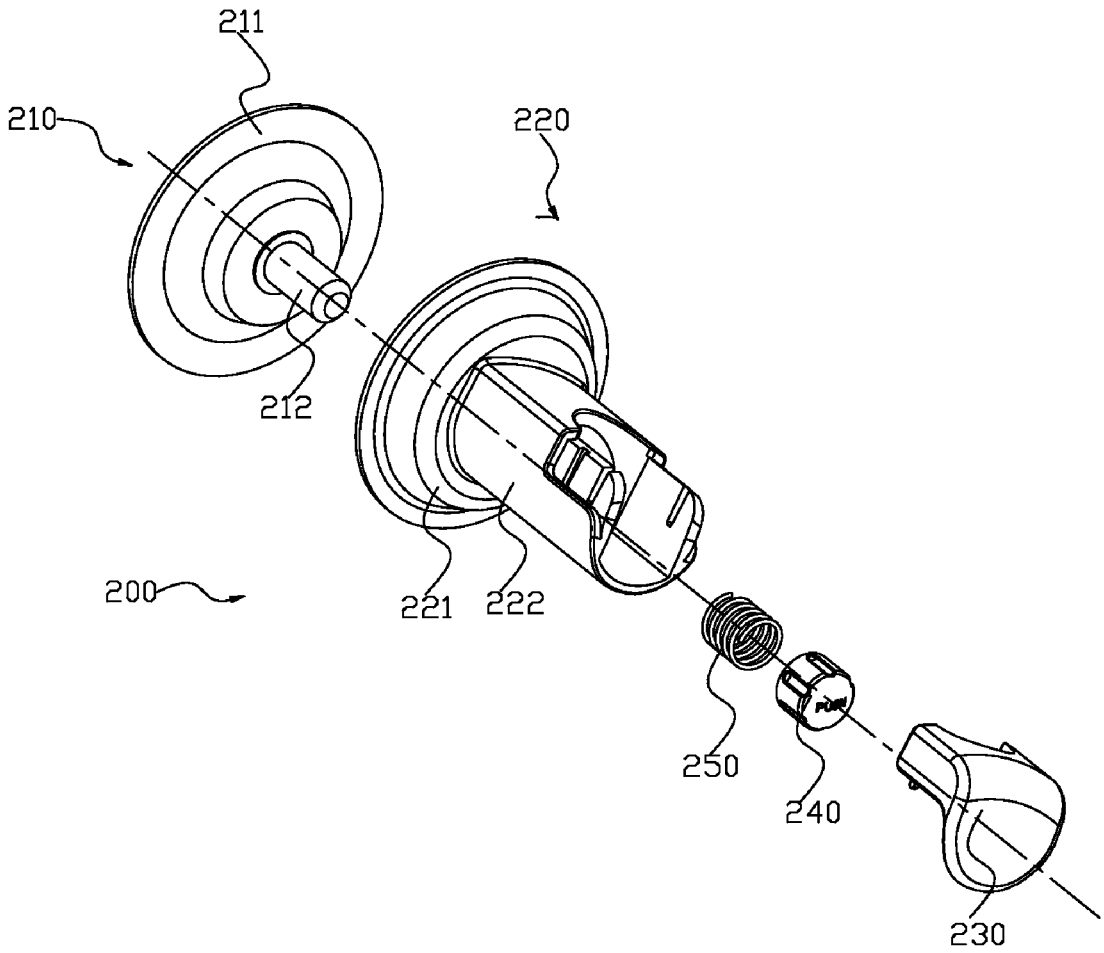
FIG. 5 is a three-dimensional exploded diagram of the sucker mechanism said suspending mechanism in a preferred embodiment of the present invention.

Referring to FIG. 1, FIG. 2 and FIG. 5, the sucker mechanism 200, which could be absorbed on the wall, includes a sucker 210, a wall base 220, a wall cover 230, a button 240 and an elastic component 250. The sucker 210 includes a sucker base 211 and a lever 212 fixed in the center of the sucker base. The sucker base 211 adopts the vacuum adsorption which belongs to the conventional technique. The wall base 220 comprises a wall cover 221 and a connecting part 222 fixed to the wall cover 221. The connecting part 222 has a top plate, a bottom and two side plates, wherein a semicircular gap is disposed in the top surface of the top plate. Said wall cover 221 is fixed to the sucker base 211 and the lever 212 is inserted in the connecting part 222. The button 240 is fixed to the end of the lever 212 and the elastic component 250 is disposed between the button 240 and the wall cover 221. So when the button 240 is pressed, the lever 212 is moved to the wall to loosen an adsorption force; when the button 240 is released, under the elastic force of elastic component 250, the lever 212 is reset, and under the pressure the sucker produces adsorption force. The other semicircular gap is disposed in the top surface of the cover 230, and the cover 230 is detachably fixed to connecting part 222 in order that the semicircular gap of the cover 230 and the other semicircular gap of the connecting part 222 form a circular groove 260.

The suspending tube 300 includes an upper part and a lower part. The lower part is suitable for the circular groove of the sucker mechanism 200 and is inserted in it, and the lower part supports the connecting part 222. The button 240 is disposed in the suspending tube 300. Two through holes 310 are disposed symmetrically in the upper part.

The supporting hoop 400 comprises a connecting sleeve 410 and two connecting sheets 420. An axial groove (slit) 411, which is through internal and external, is disposed in the connecting sleeve 410. In the embodiment, the inside diameter of the connecting sleeve 410 is equal to or more than the outside diameter of the supporting arm 100 (the connection of them are loose fit). The two connecting sheets 420 disposed symmetrically around the groove 411 are under and fixed to the connecting sleeve 410. A through hole 421 is disposed in the connecting sheets 420. In the embodiment, the two connecting sheets 420 are arc-shaped sheets whose axis coincides, and their diameters are same, and the outside diameter of the arc sheets is no less than the inside diameter of the suspending tube 300.

The elastic buckle 500 comprises a cross bar 510 and two elastic suspending arms 520 which are outward-dipping and fixed to the cross bar 510. Two convex columns are respectively disposed on the sides of the two suspending arms 520. In the embodiment, the suspending arms 520 have elasticity.

The connecting sleeve 410 of the supporting hoop 400 covers the supporting arm 100. The elastic buckle 500 is disposed between the two connecting sheets 420 of the supporting hoop 400, and under the elastic force, the convex columns 521 of the elastic buckle 500 protrude out of the through hole 421 of the two connecting sheets 420. The two connecting sheets 420 of the supporting hoop 400 are inserted in the top opening of the suspending tube 300, in order that the ends of the convex columns 521 of the elastic buckle 500 are inserted in the fixing hole 310 and the connecting sleeve 410 clasps the supporting arm 100.

The slide component 600 can be sliding connected to the suspending tube 300.

A three-way valve 700 is fixed to the end of the supporting arm 100, and the three-way valve 700 is connected to the water pipe 800 whose end is connected to the slide component 600.

All of the above is just one embodiment of the present invention, so the scope of the present invention is not limited in the embodiment. All the alternations and modifications of the present invention should be in the scope of the present invention.

What is claimed is:

1. A suspending buckle mechanism of an output water device, which connects to a supporting arm protruding out of a wall, comprising:

a sucker mechanism, which is attachable to the wall;

a suspending tube, which includes an upper part and a lower part, wherein the lower part is fixed to the sucker mechanism and the upper part has through fixing holes therein;

a supporting hoop, comprising a connecting sleeve and two connecting sheets, wherein an axial through slot is disposed in the connecting sleeve, and the two connecting sheets, each having a through hole disposed therein, are fixed to the connecting sleeve and placed symmetrically around the through slot; and an elastic buckle disposed between the two connecting sheets, and having at least two convex columns;

wherein the connecting sleeve is sleeved over the supporting arm and the two connecting sheets are inserted in an upper opening of the suspending tube, with the convex columns of the elastic buckle protruding out of the respective through holes and being inserted in the respective through fixing holes, so that the connecting sleeve clasps the supporting arm.

2. The suspending buckle mechanism of an output water device according to claim 1, wherein the two connecting sheets are arc-shaped sheets whose axis coincides, and having identical diameters, an outside diameter of the arc-shaped sheets being no less than an inside diameter of the upper opening of the suspending tube.

3. The suspending buckle mechanism of an output water device according to claim 1, wherein the elastic buckle comprises a cross bar and two elastic suspending arms which are placed symmetrically around the cross bar, and the two convex columns are respectively disposed on the sides of the two suspending arms.

4. The suspending buckle mechanism of an output water device according to claim 1, further comprising a slide component which is slidingly connected to the suspending tube.

5. The suspending buckle mechanism of an output water device according to claim 4, further comprising a three-way valve disposed at an end of the supporting arm, the three-way valve being connected to a water pipe having an end connected to the slide component.

6. The suspending buckle mechanism of an output water device according to claim 1, wherein the sucker mechanism comprises:

a sucker, comprising a sucker base and a lever fixed in a center of the sucker base;

a wall base fixed to the sucker, which has a wall cover and a connecting part fixed to the wall cover;

a further cover, which is detachably fixed to the wall base, and forms a slot together with the connecting part; and a button and an elastic component, an end of the lever being inserted into the slot and fixed to the button, the elastic component being disposed between the button and the wall base.

* * * * *